US005218822A

United States Patent [19]

Legg

[11] Patent Number: 5,218,822

[45] Date of Patent: Jun. 15, 1993

[54] AIR START/ASSIST FOR TURBOCHARGERS

[75] Inventor: David W. Legg, Gambier, Ohio

[73] Assignee: Cooper Industries, Inc., Houston, Tex.

[21] Appl. No.: 821,481

[22] Filed: Jan. 15, 1992

[51] Int. Cl.[5] ..... F02B 37/00; F01D 19/00

[52] U.S. Cl. ..... 60/611; 415/116

[58] Field of Search ..... 60/607, 608, 611, 39.142; 415/116

[56] References Cited

U.S. PATENT DOCUMENTS

| | | | |
|---|---|---|---|
| 2,457,833 | 1/1949 | Redding | 415/116 X |
| 2,656,675 | 10/1953 | Coar . | |
| 2,989,848 | 6/1961 | Paiement | 415/116 X |
| 3,190,068 | 6/1965 | Williams et al. | 60/611 X |
| 3,238,721 | 3/1966 | Brandes et al. | 60/39.142 X |
| 3,370,417 | 2/1968 | Koziara | 60/611 |
| 3,396,534 | 8/1968 | Bernson et al. | 60/611 |
| 3,462,071 | 8/1969 | Garve . | |
| 3,676,999 | 7/1972 | Oldfield . | |
| 4,285,200 | 8/1981 | Byrne et al. | 60/607 |
| 4,689,960 | 9/1987 | Schroder et al. | 60/609 |
| 4,696,165 | 9/1987 | Bucher | 60/609 |
| 5,022,530 | 6/1991 | Kamamura | 123/21 |

FOREIGN PATENT DOCUMENTS 711904 7/1954 United Kingdom .

*Primary Examiner*—Michael Koczo
*Attorney, Agent, or Firm*—David A. Rose

[57] ABSTRACT

The compressor for a turbocharger includes an assist system to provide a power stream of a driving fluid such as air to act on the impeller of the compressor until the driving power of the exhaust gases from an internal combustion engine are sufficient to drive the impeller. The compressor includes a housing forming a compression chamber in which the impeller is rotatably disposed. The impeller has a floor with a plurality of blades projecting from the floor. A plenum surrounds the housing and is connected to a source of pressurized air for supplying air to the compression chamber to drive the impeller. An aperture is provided through the housing for each blade and communicates the air from the plenum to the compression chamber and against the blades. The axis of the aperture is coincident with a line extending from the lower outer radial edge of the blade adjacent the floor to the point at which the air jet from the aperture impinges upon the next successive blade

8 Claims, 4 Drawing Sheets

FIG. 3
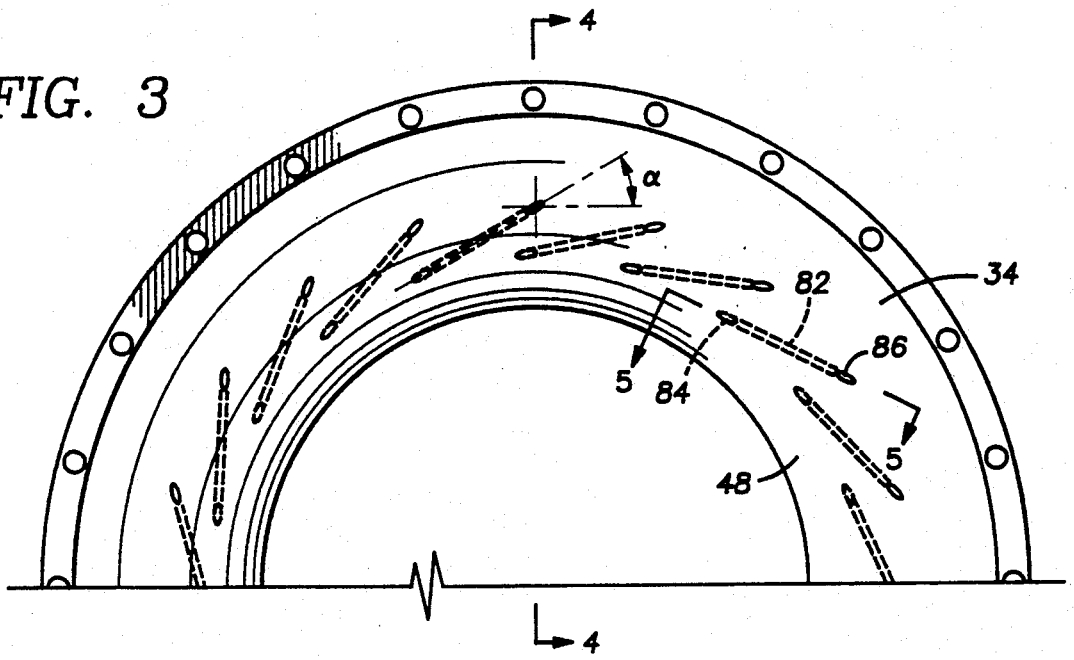
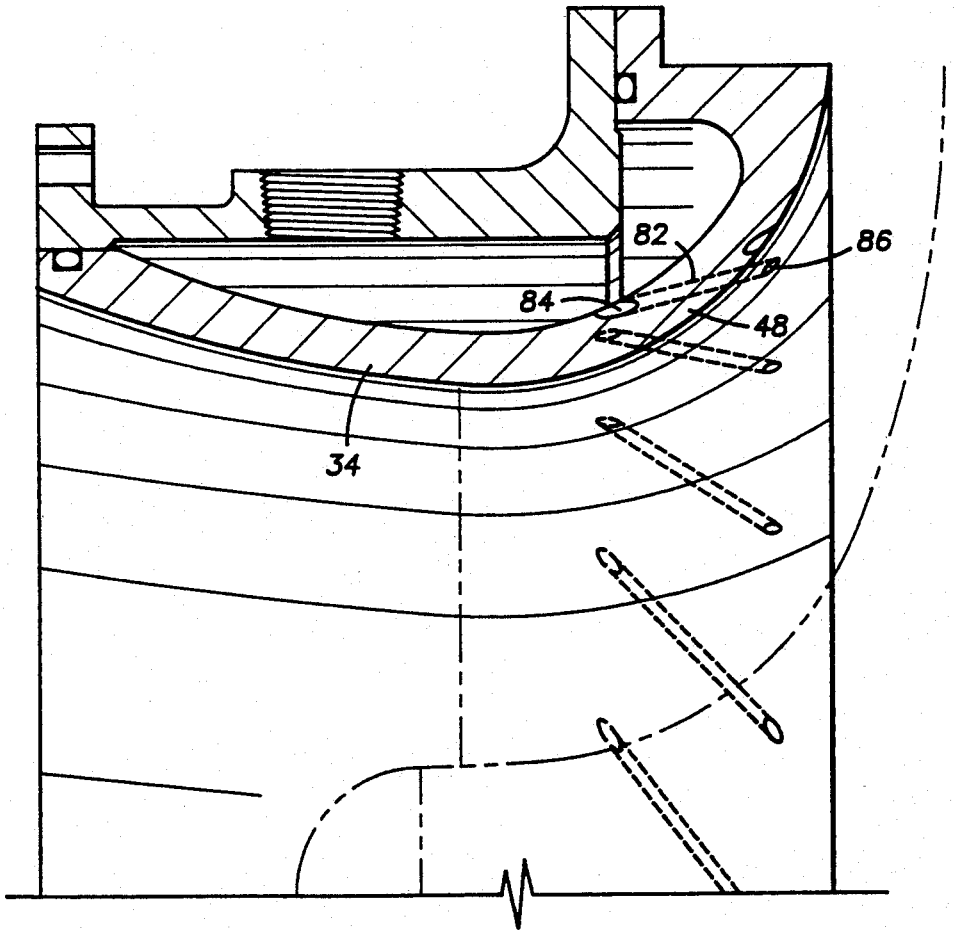
FIG. 4

AIR START/ASSIST FOR TURBOCHARGERS

BACKGROUND OF THE INVENTION

The present invention relates to turbochargers having a centrifugal compressor driven by the exhaust gases from an internal combustion engine and, more particularly, to an assist system to inject a power stream of auxiliary driving fluid which acts on the compressor wheel until the driving power of the exhaust gases is sufficient.

Turbochargers for internal combustion engines include a centrifugal compressor mounted on a common shaft with a turbine. The high pressure exhaust from the internal combustion engine drives the turbine such that the rotating turbine causes the compressor wheel of the compressor to rotate. The air entering the inlet of the compressor is then compressed by the compressor wheel which discharges the pressurized air into the inlet of the internal combustion engine thereby resulting in an improved efficiency for the engine. In this manner, the turbocharger transfers energy from the engine exhaust gas to the engine's intake air.

During the start-up of the internal combustion engine, the energy available from the exhaust gases is insufficient to effectively drive the turbocharger. Therefore, to obtain rapid acceleration of the engine or to obtain a better operation of the engine under accelerating conditions the turbocharger includes an air start-/assist system which directs a stream of auxiliary driving fluid such as compressed air onto the vanes or blades of the compressor wheel to generate increased torque on the compressor wheel to thereby increase the speed of rotation of the wheel. An air manifold or distribution chamber extends around the compressor housing as a compressed air supply and the housing includes a plurality of nozzles shaped so that they direct a jet of compressed air at an angle to the vanes or blades.

U.S. Pat. No. 3,462,071 discloses a turbocharger compressor which includes nozzles for directing an auxiliary propellant against the trailing faces of the blades. Tangential feed lines provide auxiliary propellant to the compressor manifold and the housing includes a plurality of bladed nozzles directed toward the blades of the compressor wheel.

U.S. Pat. No. 4,689,960 discloses a compressor housing having an odd number of nozzles directed toward the impeller at an angle. The angle causes the axis of the nozzles to be in a plane parallel to the axis of the compressor wheel and at an angle of 15 to 25 degrees in that plane. Alternatively, the axis may be in a plane which is inclined with respect to the axis of rotation of the compressor wheel so that the compressed air will flow in a preferred direction towards the outer edge of the wheel.

U.S. Pat. No. 4,696,165 discloses a plurality of nozzles positioned around the entire circumference of the impeller casing.

Prior art systems have the disadvantage that undue stresses are placed on the blades resulting from the high pressure air jets acting on the impeller blades. These stresses cause the blades to oscillate at their natural frequency, thereby shortening blade life and resulting in dangerous vibrations. Hence, an assist system is desired which applies maximum force to the compressor wheel while minimizing the adverse oscillation and uneven loading on the blades.

Further, prior art assist systems teach a minimum number of nozzles or an uneven distribution of nozzles around the compressor wheel so as to provide an uneven loading of forced air onto individual blades as the blades rotate on the compressor wheel. Also, the nozzles are directed radially such that the compressed air can either impinge on the base of the compressor wheel between adjacent blades or exit between the blades without impinging on the wheel at all, or the nozzles are directed tangentially causing the air to flow towards the hub of the compressor wheel thereby losing efficiency. Further, the number of nozzles, the geometry and angles of the nozzles of the prior art do not provide optimum efficiency for the air start/assist system of the turbocharger.

BRIEF DESCRIPTION OF THE DRAWINGS

For a detailed description of a preferred embodiment of the invention, reference will now be made to the accompanying drawings wherein:

FIG. 3 is an end view of the inlet casing of the compressor, taken along lines 3—3 of FIG. 2;

FIG. 4 is a side view of the inlet casing of the compressor, taken along lines 4—4 of FIG. 3;

SUMMARY OF THE INVENTION

The air start/assist system of the present invention includes an air supply plenum formed around the impeller blades of the compressor wheel. A plurality of air apertures are azimuthally spaced around the circumference of the housing of the air plenum adjacent the compressor wheel. One air aperture is provided for each blade on the compressor wheel. The flow axis of the air aperture has an angle of inclination with a tangential and a radial component whereby the jet of forced air passing through the air aperture initially engages a first blade at a point on its outer radial edge more than one quarter of the radius from the periphery of the wheel and terminates its impingement at the outer terminal end of the blade adjacent the floor of the wheel while simultaneously initiating its impingement on a succeeding adjacent second blade of the compressor wheel.

In operation, the air assist system applies additional spinning force to the compressor impeller of the turbocharger during periods when the energy from the exhaust gases is insufficient to maintain impeller speed at the desired level. The additional force is applied through the use of a auxiliary propellant, typically compressed air, which is blown against the blades of the impeller causing the impeller to spin. The present invention discloses a novel assist system which minimizes stress and vibration on the impeller blades and provides the maximum efficient use of the compressed air energy.

Other objects and advantages of the present invention will appear from the following description.

DESCRIPTION OF A PREFERRED EMBODIMENT

Figure 1:
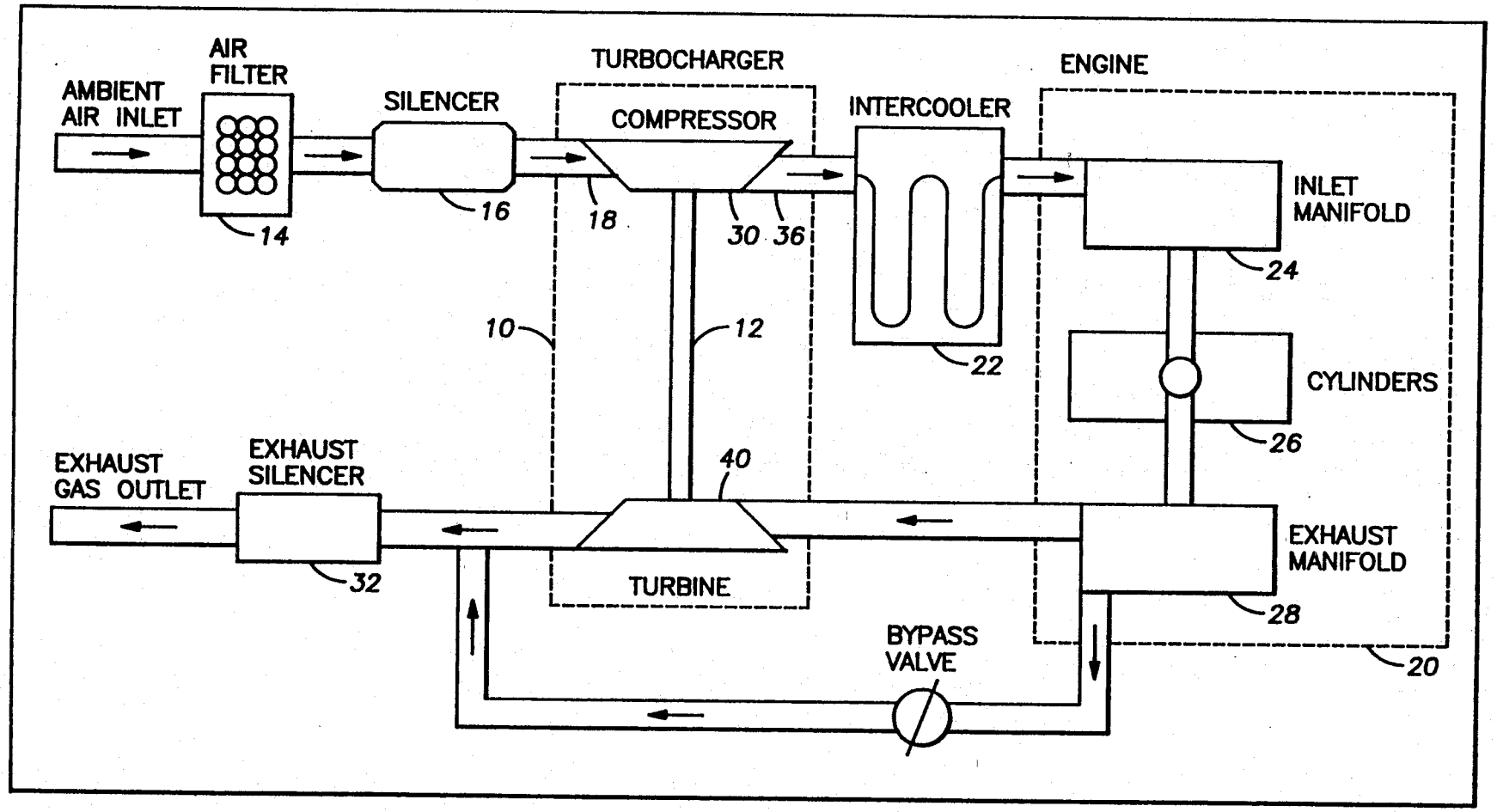
FIG. 1 is a schematic drawing of an internal combustion engine having a turbocharger.
Figure 2:
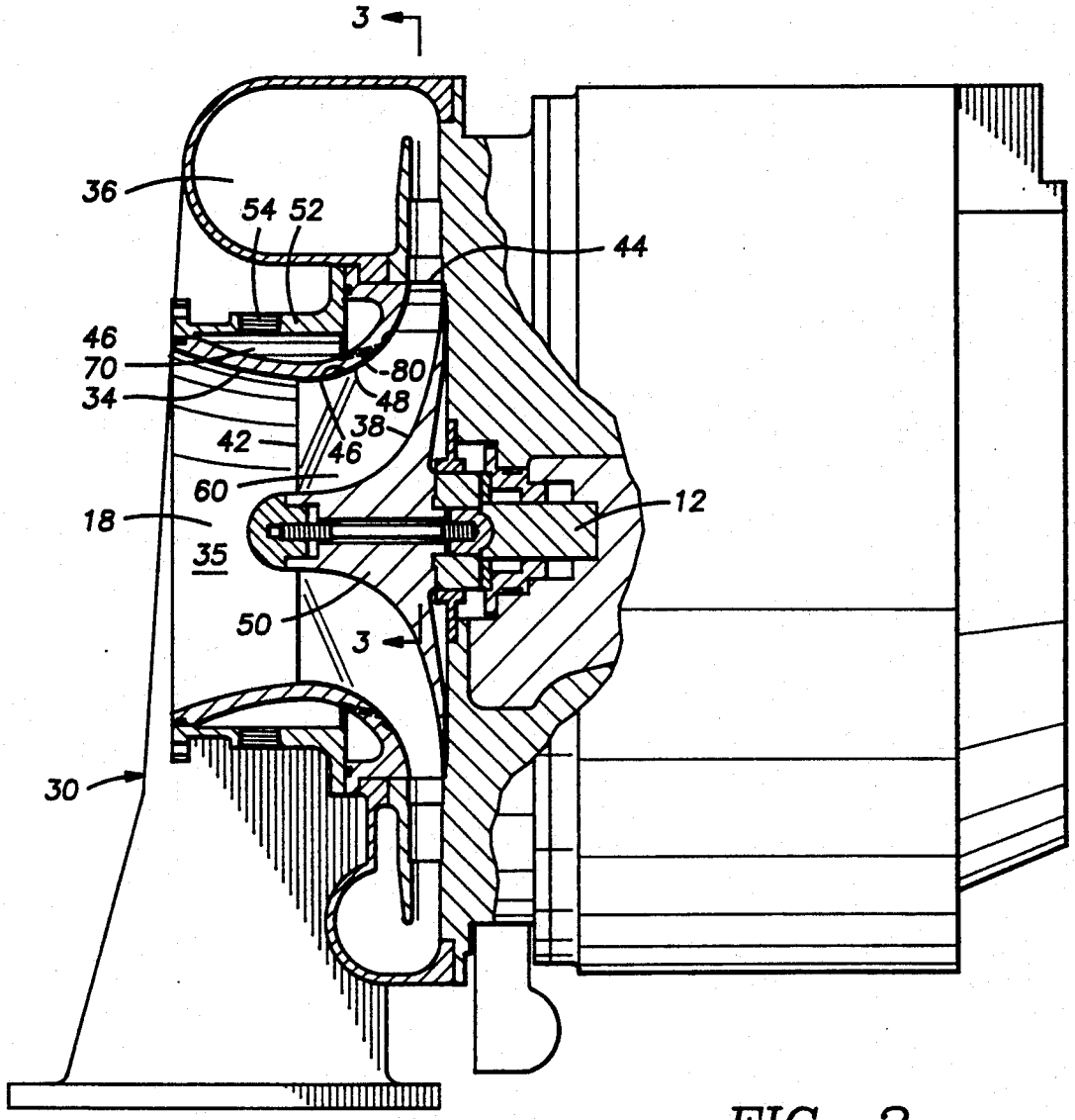
FIG. 2 is a cross-section of the compressor of the turbocharger

Referring initially to FIGS. 1 and 2, there is shown a turbocharger 10 for an engine 20 such as an internal combustion engine. The turbocharger 10 includes a compressor 30 rotatably connected to a turbine 40 by a common shaft 12. Upstream of compressor 30, the ambient air passes through an air filter 14 and silencer 16 to dampen the noise prior to the air passing into the inlet 18 of compressor 30. The ambient air is compressed by compressor wheel or impeller 50 rotatably mounted on common shaft 12. Upon leaving compressor 30, the compressed air passes through an intercooler 22 and finally into the inlet manifold 24 of engine 20. The air is directed into cylinders 26 for combustion with fuel and the exhaust exits engine 20 via exhaust manifold 28. The exhaust from exhaust manifold 28 then passes through exhaust turbine 40 and finally through silencer 32.

DESCRIPTION OF A PREFERRED EMBODIMENT

Referring initially to FIGS. 1 and 2, there is shown a turbocharger 10 for an engine 20 such as an internal combustion engine. The turbocharger 10 includes a compressor 30 rotatably connected to a turbine 40 by a common shaft 12. Upstream of compressor 30, the ambient air passes through an air filter 14 and silencer 16 to dampen the noise prior to the air passing into the inlet 18 of compressor 30. The ambient air is compressed by compressor wheel or impeller 50 rotatably mounted on common shaft 12. Upon leaving compressor 30, the compressed air passes through an intercooler 22 and finally into the inlet manifold 24 of engine 20. The air is directed into cylinders 26 for combustion with fuel and the exhaust exits engine 20 via exhaust manifold 28. The exhaust from exhaust manifold 28 then passes through exhaust turbine 40 and finally through silencer 32.

Referring now to FIG. 2, compressor 30 includes a compressor housing 34 having a compression chamber 35 in which is disposed compressor wheel or impeller 50 mounted on common shaft 12. The compression chamber 35 includes a air inlet 18 and an air discharge 36. Impeller 50 includes a plurality of radial vanes or blades 60 integral with a base or floor 38. Floor 38 is circular having a radius and an outer periphery. Blades 60 include an inlet end 42 and a discharge end 44 The outer radial edge 46 of blades 60 extending between inlet end 42 and discharge end 44 of blade 60 is arcuate. As shown, the interior of housing 34 has a J-shaped curvature with a curved portion 48 which comports with the arcuate radial curvature of outer radial edge 46 and is dimensioned to provide a rotating clearance therebetween. A cover 52 is provided around housing 34 to form an air supply plenum 70. Pressurized air is supplied to air plenum 70 through an air inlet 54 from an external pressurized air supply. The source of pressurized air preferably supplies air in the pressure range of 100 to 150 psi.

According to the present invention, a plurality of air apertures or bores 80 are drilled at an angle through the housing 34. These bores 80 are positioned and shaped to direct compressed air from plenum 70 onto the impeller blades 60 and are preferably 5/32 of an inch in diameter. Without departing from the spirit of the present invention, the bores 80 may also be drilled through a built up nub or head (not shown) in housing 34 to provide a perpendicular surface for the drill bit, or may be replaced with separately machined jets or nozzle fittings embedded in housing 34, or with angled baffles, or any other such air directing means as are well known in the art. It will be understood that the construction of bores 80 is not critical to the present invention.

Referring now to FIGS. 3 and 4, bores 80 are azimuthally spaced around the circumference of the curved portion 48 of housing 34. The number of bores 80 equals exactly the number of impeller blades 60. The requirement that the number of bores 80 equal the number of blades 60, in combination with the limitations on the direction of the jets of air passing from bores 80 described below, means that each blade 60 is subjected to a constant force and that a jet of air is continuously impinging on each blade 60 as the impeller 50 rotates on shaft 12.

Figure 7:
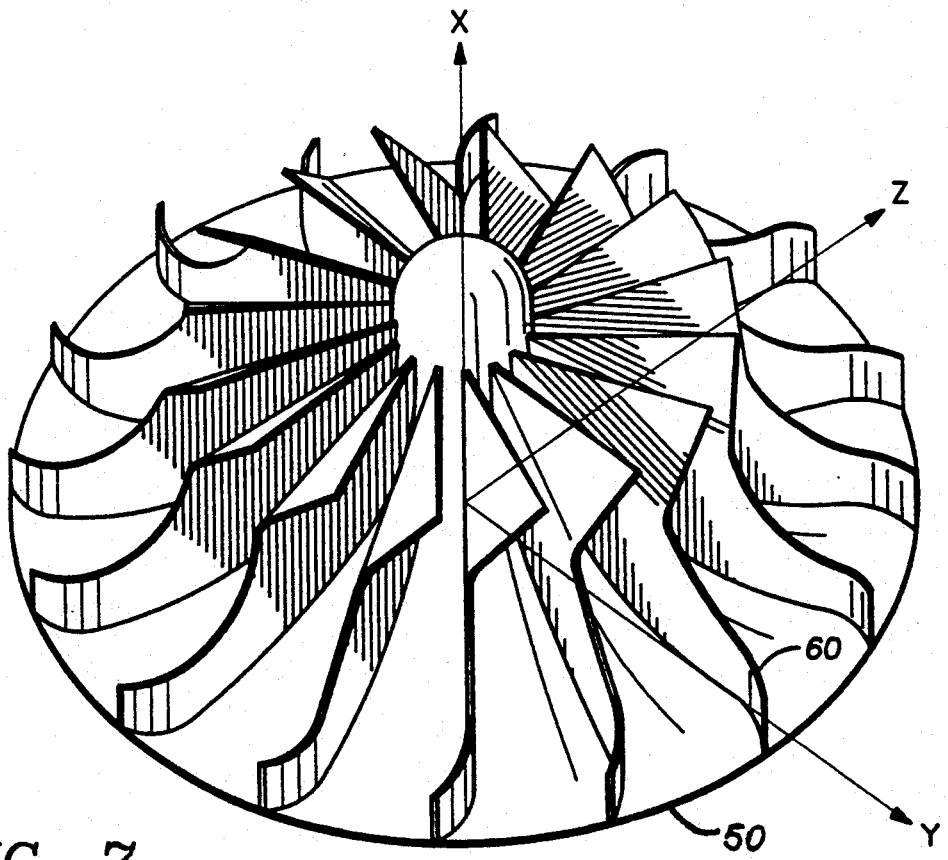
FIG. 7 is a perspective view of a lean-back impeller.

For the purpose of facilitating discussion of the direction of bores 80, a coordinate system will be defined and used hereinafter in reference to the preferred angles of the bores 80 of the present invention. Assuming a set of coordinates x, y, z, passing through the axis of rotation of the compressor wheel 50, the x direction is defined as being parallel to the axis of rotation of the compression wheel 50. As seen in FIG. 7 for any given blade 60 of the impeller wheel 50, the y direction is used to represent the radial component in the direction away from the axis of rotation of the impeller wheel 50, and the z component represents the tangential component of an angle. Hence, an angle with no z component would be parallel to the blade 60, while an angle with no component would be perpendicular to the blade 60. See the x, y, z coordinates set forth on FIG. 7.

Referring to FIGS. 3 and 4, it will be understood that a bore 80 aimed through the housing 34 at an angle will direct a jet of air from the plenum 70 into the region of the impeller blades 60 at that same angle. A typical bore 82, for example, includes an inlet end 84 and a discharge end 86. Inlet end 84 communicates with air plenum 70 and discharge end 86 communicates with the clearance between curved portion 48 of housing 34 and the outer radial edge of blade 60 directing the driving fluid or compressed air onto blades 60. Bores 80 are preferably circular in cross-section for ease of manufacture. The diameter of bores 80 provide a predetermined cross-sectional area regulating the volume of air flow through an individual bore 82 depending upon the air pressure within air plenum 70. The air pressure within the plenum 90 is coordinated with the total cross-sectional area for all bores 80 to provide a uniform predetermined air onto blades 60.

Figure 6:
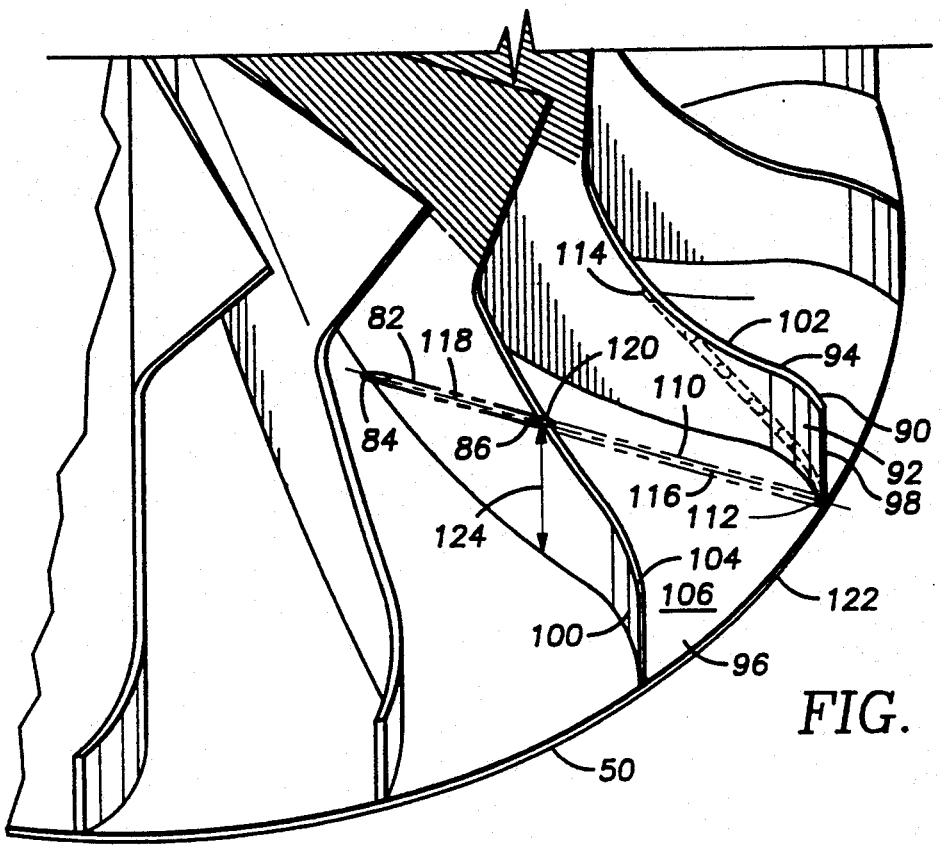
FIG. 6 is a perspective view of a typical compressor wheel showing the footprint of the jet of air as it traverses a typical blade.

Referring now to FIGS. 6 and 7, typical air aperture or bore 82 is shown positioned relative to two adjacent successive vanes or blades 90 and 100. Blade 90, as shown, advances prior to blade 100. Blade 90 is generally planar, although it may have a slight curvature depending on the type of impeller used in the compressor. Blade 90 includes a trailing face or side 92 and a compression face or side 94. As shown, the blade 90 is attached to the base or floor 96 of compressor wheel 50 and has a discharge terminal end 98 and an arcuate radial edge 102. The trailing side 92 of blade 90 and the compression side 104 of blade 100, together with that portion of the base 96 of wheel 60 extending therebetween, form a channel 106 for the passage of air.

The air aperture or bore 82 is positioned in housing 34 so that the compressed air exiting discharge end 86 provides a flaring flow pattern of air, such as 110, forming a footprint, such as 112, on the trailing side of blade 90. A succession of footprints formed at distinct and successive points in time are shown across the trailing side of blade 90 beginning with footprint 114 as the air begins its impingement on blade 90 and terminates its impingement with footprint 112 at the discharge end 98 adjacent the floor 96 of wheel 60 as shown by footprint 112. The flow pattern 110 formed by bore 82 terminating at footprint 112 has an axis 116 which coincides with the axis 118 of bore 82. The preferred axis 116 of flow pattern 110 is formed by aligning the center of footprint 112 with the center of initial footprint 120 of the impingement of air on blade 100 following blade 90. The line between these two points determines the axis of bore 82. The axis 116 of flow pattern 110 can be located by determining the length of arcuate chord 122 between adjacent blades 90, 100 at the peripheral edge of wheel 60, the height 124 of blade 100 at the point of air impingement at the initial footprint 120, and the radial distance between footprint 120 and the periphery of wheel 60.

The preferred angle of inclination for bores 82 results in an air jet which avoids the air impinging on the floor 96 of the impeller wheel 50 or exiting between the blades 90, 100 without impinging on them. Any air impinging on floor 96 or missing the blades completely obviously provides no torque to impeller 50. The x, y, and z components of the angle are such that the footprint 110 of the air on the blades 60 as seen in FIG. 7 traverses the trailing side 92 of the blade 90 from a point on the upper edge 102 of the blade, approximately at one-quarter of the radius from the periphery 90, to a point at the lower outer terminal edge of the blade 90. It is further preferred that the air jet begins to impinge on the succeeding blade 100 before it leaves the surface of the previous blade 90.

In order to achieve the desired path of the footprint on a variety of impellers, it is desirable to vary the radial position of the point of exit of the bore 80. Because of manufacturing limitations, it is preferred to vary the radial position of the point of entry of bore 80 instead of the angle of inclination of the bore 80, leaving fixed the x, y, and z components of that angle. Additionally, the curved portion 48 of the housing 34 is a limitation on the amount by which the radius of the point of entry of the bore 80 can be decreased. Hence, the optimum position of the bore with respect to the housing 34 will be defined by several parameters. Variations between housings in the true thickness of the housing, and the changes in the apparent thickness which occur as the curvature of curved portion 48 varies with the radius for a standard 24-inch impeller, result in bores which can vary in length from three to six inches.

It will be understood that as the y component of the nozzle angle increases relative to the z component , the radius along the blade 90 at which the air jet can exit the bore 82 and still traverse blade 90 as desired decreases. Hence, positioning the bore exit 86 at a radius more than one-quarter of the radius of the blade 90 from the periphery enables the y component to be increased to a degree not contemplated in the art. Increasing the y component minimizes the amount of air from the jet which is deflected radially inward along the trailing face 92, thereby increasing the efficiency of the system.

Figure 5:
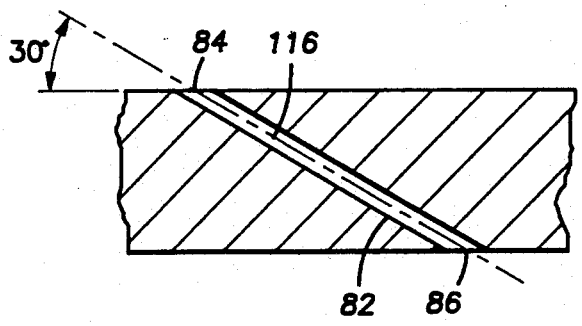
FIG. 5 is a cut-away view of one portion of the inlet casing, showing the air aperture therethrough.

The preferred angle of inclination for the bores 80 is best seen in FIGS. 3 and 5. Referring to FIG. 3, the projection of the bore angle on the y, z plane is depicted. According to the present invention, the angle of the bores 80 is such that the projected angle intersects a line perpendicular to a radius at the point of exit of the bore 80 at an angle $\alpha$, which is approximately 16° 20′ for a straight bladed compressor wheel and approximately 30° for a lean-back compressor wheel.

It will further be understood that as the x component of the nozzle angle increases relative to the z component, the likelihood that the air jet will impinge on the floor 96 of the impeller 50 between the blades 90, 100 increases. Hence the present invention requires that the component be sufficiently great that the footprint of the air jet will begin to impinge on the succeeding blade before it leaves the lower outer radial edge of each blade.

Referring now to FIG. 5, the angle of the bore 80 through the casing is shown. According to the present invention, the angle of each bore is such that a projection of the angle on an x, z plane at the inlet of the bores describes an angle of 30° with respect to the z axis.

A result of the requirements of the present invention is that variations in the force applied to the blades 60 are minimized and blade oscillation is significantly reduced. Additionally, efficiency is increased because reduced inward deflections of air results in reduced air turbulence in the channel between the blades 60.

As alternative embodiment, the invention can be adapted to provide the same footprint path across the blades of a lean-back impeller, such as is shown in FIG. 7. It will be understood that the variation in the orientation of the blade faces from the radial orientation of a straight bladed compressor wheel results in a change in the desired angle of inclination of the bores 80, as described above.

While a preferred embodiment of the invention has been shown and described, modifications thereof can be made by one skilled in the art without departing from the spirit of the invention.

I claim:

1. A compressor for a turbocharger, comprising:

a housing having a compression chamber in which is rotatably disposed an impeller;

said impeller having a circular floor with a radius and periphery and a plurality of blades projecting from said floor, each said blade having a compression side and a trailing side with an outer radial edge adjacent said housing and a terminal end adjacent said periphery of said floor;

a plenum surrounding said housing and adapted for communication with a source of pressurized air;

said housing having a curved portion adjacent said outer radial edge and an aperture for each said blade projecting from said plenum to said compression chamber;

said aperture having an axis coincident with a line extending between a point on said trailing side of a first blade adjacent said terminal end of said first blade and said periphery of said floor and a point on said outer radial edge of a succeeding blade, said point positioned radially inwardly from said periphery at least one-quarter of said radius of said floor.

2. A compressor for a turbocharger, comprising:

a housing having a compression chamber in which is rotatably disposed an impeller;

said impeller having a circular floor with a radius and periphery and a plurality of blades projecting from said floor, each said blade having a compression side and a trailing side with an outer radial edge adjacent said housing and a terminal end adjacent said periphery of said floor;

a plenum surrounding said housing and adapted for communication with a source of pressurized air;

said housing having a curved portion adjacent said outer radial edge and an aperture for each said blade extending from said plenum to said compression chamber;

said aperture exiting said housing at a point positioned radially inwardly from said periphery at least one-quarter of said radius of said floor.

3. The compressor of claim 2 wherein said apertures are evenly spaced about said housing.

4. The compressor of claim 3 wherein said apertures are positioned so that streams of air exiting said apertures apply a substantially constant force on each blade as the impeller revolves.

5. The compressor of claim 2 wherein said aperture has an axis defined by the length of an arcuate chord between adjacent blades, the height of each blade at said point of exit of said apertures, and the radial distance from said periphery to said point.

6. The compressor according to claim 2 wherein a stream of air directed by said aperture traverses each blade as the impeller rotates but never impinges on said impeller floor.

7. The compressor according to claim 2 wherein said aperture is positioned so that said stream of air never exits from between said blades without impinging on said blades.

8. A compressor for a turbocharger, comprising:

a housing having a compression chamber in which is rotatably disposed an impeller;

said impeller having a circular floor with a radius and periphery and a plurality of blades projecting from said floor, each said blade having a compression side and a trailing side with an outer radial edge adjacent said housing and a terminal end adjacent said periphery of said floor;

a plenum surrounding said housing and adapted for communication with a source of pressurized air;

said housing having a curved portion adjacent said outer radial edge and an aperture for each said blade projecting from said plenum to said compression chamber;

said aperture having an axis having a tangential component and a radial component, said aperture positioned so that a stream of air exiting said aperture simultaneously passes off terminal end of a first blade adjacent to said impeller floor and begins to impinge on a succeeding blade at a point on said outer radial edge of said succeeding blade.

* * * * *